US006336840B2

(12) United States Patent
Heroff

(10) Patent No.: US 6,336,840 B2
(45) Date of Patent: Jan. 8, 2002

(54) ARTICLE OF CLOTHING WITH BUILT-IN BRA

(76) Inventor: Stephanie L. Heroff, 206 Warwick St., SE., Minneapolis, MN (US) 55414-3623

( * ) Notice: Subject to any disclaimer, the term of this patent is extended or adjusted under 35 U.S.C. 154(b) by 0 days.

(21) Appl. No.: 09/727,029

(22) Filed: Nov. 30, 2000

Related U.S. Application Data

(63) Continuation of application No. 09/358,274, filed on Jul. 21, 1999, now Pat. No. 6,162,111, which is a continuation-in-part of application No. 09/345,256, filed on Jun. 30, 1999.

(60) Provisional application No. 60/091,374, filed on Jul. 1, 1998.

(51) Int. Cl.[7] ..... A41C 3/00

(52) U.S. Cl. ..... 450/30; 450/31; 450/1; 2/69

(58) Field of Search ..... 450/1, 11, 14–16, 450/26.28, 30, 31, 35; 2/69, 67, 115, 105, 106

(56) References Cited

U.S. PATENT DOCUMENTS

| | | | | |
|---|---|---|---|---|
| 2,080,703 A | | 5/1937 | Fine | |
| 2,558,420 A | | 6/1951 | D'Amato | |
| 2,633,440 A | | 3/1953 | Scholl | |
| 2,790,177 A | | 4/1957 | Blitch | |
| 3,311,112 A | | 3/1967 | Murray | |
| 3,343,545 A | | 9/1967 | Kress | |
| 3,565,081 A | | 2/1971 | Barg | |
| 3,648,835 A | | 3/1972 | Yucel | |
| 3,677,252 A | | 7/1972 | Pedley | |
| 3,746,007 A | | 7/1973 | Hand et al. | |
| 4,372,320 A | | 2/1983 | Silber | |
| 4,398,538 A | | 8/1983 | Johnson | |
| 4,522,870 A | | 6/1985 | Esmay | |
| 4,564,015 A | | 1/1986 | Friedman | |
| 4,582,737 A | | 4/1986 | Torgerson et al. | |
| 4,636,427 A | | 1/1987 | Ohno et al. | |
| 4,798,557 A | | 1/1989 | Scott | |
| 4,842,919 A | | 6/1989 | David et al. | |
| 4,844,973 A | | 7/1989 | Konishi et al. | |
| 5,045,018 A | | 9/1991 | Costanzo | |
| 5,130,185 A | | 7/1992 | Ness | |
| 5,332,607 A | | 7/1994 | Nakamura et al. | |
| 5,478,278 A | * | 12/1995 | Greenblatt | 2/67 |
| 5,543,190 A | | 8/1996 | Johnson et al. | |
| 5,590,545 A | | 1/1997 | Norris | |
| 5,678,246 A | * | 10/1997 | Cooley et al. | 2/67 |
| 5,914,166 A | | 6/1999 | Le | |
| 6,162,111 A | * | 12/2000 | Heroff | 450/30 |

* cited by examiner

*Primary Examiner*—Gloria M. Hale

(57) ABSTRACT

The present invention is directed to women's clothing apparel including a built-in bra. In preferred embodiments, the straps of the bra are fastened to the shoulder supports of a top garment substantially along the length of the shoulder supports from the front to the back of the garment. The invention also provides novel bras which can be advantageously used according to the invention.

20 Claims, 12 Drawing Sheets

55
72
66a
67a
68a
66b
67b
68b
70a
70b
69
63
64b
56
60
61
64a 55
66a
67a
68a
66b
67b
68b
60
61
64a
71
62
65a
65b
64b
56

300
301
302b
303b
305b
303a
302a
305a 303a
302a
304a
301
302b
304b
303b
300

ARTICLE OF CLOTHING WITH BUILT-IN BRA

CROSS REFERENCE TO RELATED APPLICATIONS

The present application is a continuation of Ser. No. 09/358,274 filed Jul. 21, 1999, now U.S. Pat. No. 6,162,111 which is a continuation-in-part application of U.S. Ser. No. 09/345,256, filed Jun. 30, 1999, which claims priority to provisional application U.S. Ser. No. 60/091,374, filed Jul. 1, 1998 the entire disclosure of each application is incorporated herein by reference.

FIELD OF THE INVENTION

The present invention is directed to women's clothing apparel, particularly garments which cover a woman's breasts. Specifically, the invention provides for fixing at least a portion of a bra to the garment under which the bra is worn.

BACKGROUND OF THE INVENTION

Presently available women's clothing apparel generally do not include breast support. Typically, breast support systems, such as a bra, are a component separate from the shirt or dress and have a separate strap arrangement for supporting the bra and garment over a woman's shoulder.

One disadvantage of having a separate strap for the bra and for the garment is that the bra strap can be displaced from being completely covered by the garment shoulder strap when a woman performs routine activities while wearing the garment/bra arrangement. Exposure of the bra strap beneath the garment strap can give an unkempt look. This can be a particular problem when the shoulder support straps of the, garment are thin, i.e., about the same width as the bra strap. In addition, the independent movement of the two straps on a woman's shoulder can be constantly irritating and require repeated manual adjustment to realign the bra strap and the garment strap.

One alternative is to use a single strap to provide over-the-shoulder support to both the cup portions of the bra and the garment. Such arrangements are disclosed in, for example, U.S. Pat. Nos. 4,398,538 and 4,798,557. However, in general, arrangements having a single strap for both the bra and garment do not provide the support necessary for full figured women.

Another alternative is to provide the garment with a built in bra. Such arrangements are disclosed in, for example, U.S. Pat. Nos. 5,478,278 and 5,678,246. While these arrangements may provide adequate breast support, the bra and garment are generally fixed together over portions of the body of the bra (i.e., cups, sides and back region) and the strap region. This arrangement can be disadvantageous because the garment cannot move freely relative to the body of the bra.

Clasp systems are available for fixing the garment strap and bra strap in position as illustrated in U.S. Pat. No. 5,590,545. However, in addition to being unsightly, clasps generally only provide a localized point of fixation thus allowing relative displacement between the garment shoulder strap and the bra strap at regions that are not directly fixed together by the clasp.

Another alternative is to not wear a bra when wearing a sleeveless or thin strapped garment. This, however, is frequently a disadvantage for full figured women or women performing sports or other physical activities.

Accordingly, there is a need for women's garments, particularly garments that are sleeveless or thin strapped, that permits constant coverage of the strap of an underlying bra by the garment shoulder strap.

SUMMARY OF THE INVENTION

Throughout the specification, guidance is provided through lists of examples. In each instance, the recited list serves only as a representative group. It is not meant, however, that the list is exclusive.

The invention is directed to articles of clothing including a garment and a bra or bra straps. According to the invention, a garment can include a first and second garment support which extend from the front of the garment to the back of the garment. Alternatively, a garment can include a first and second garment support which extend from the front of the garment to behind the wearer's neck where the first and second garment supports attach to one another.

A bra according to the invention includes a bra body and first and second bra straps. The bra body has a front, a back and sides. In a typical embodiment, the first and second bra straps are fastened to the first and second garment supports, respectively. The bra straps can be non-removable or selectively removable from the garment supports. In some embodiments, the body of the bra can be selectively detachable from the bra straps.

Articles of clothing according to the invention are particularly advantageous for use with garments having garment supports which are narrow, such as "spaghetti straps." The garment of an article of clothing according to the invention can be a dress, a blouse, a tank top, halter top, tube top, bathing suit, etc.

Fastening the bra straps to the garment supports provides the herein disclosed articles of clothing with an overall neater appearance. In addition, the articles provide breast support and comfort for regular use or for use during physical activity.

DETAILED DESCRIPTION

Figure 1C:
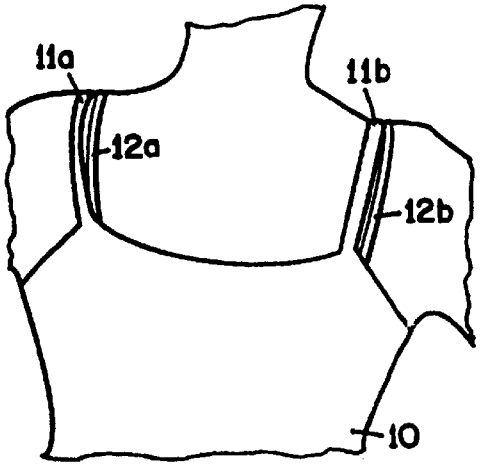
FIGS. 1*a*–1*c* illustrate an embodiment of a prior art garment and bra arrangement.

The present disclosure is directed to women's garments, worn with a bra underneath, that provides substantial, continuous coverage of the strap of the bra. In a preferred embodiment, the garment is mobile relative to the body of the bra.

As used herein, the term "garment" refers to women's clothing apparel that covers the upper body region including the breasts, for example, dresses, blouses, t-shirts, tank tops, bathing suits, halter tops, tube tops, etc. The "garment shoulder support" or "garment support" refers to that region of the garment that extends from the front of the garment to the back of the garment in the shoulder region to support the garment on a woman's shoulder (i.e., over-the-shoulder-support). The garment support can be narrow or broad. According to the invention, narrow and broad garment supports include the supports of all sleeveless garments. Narrow and broad support garments may include lateral extensions such as long or short sleeves. The over-the-shoulder supports of a garment having narrow shoulder supports (e.g., straps), may sometimes be referred to as "spaghetti straps."

As used herein, the term "bra" refers to common breast support systems which fall under the term "bra" and which have a "bra strap" that extends from the front of the bra over a woman's shoulder to the back of the bra. The "body" of the bra includes the front, back and sides of the bra. The "front" of the bra includes that portion of the bra which directly surrounds or supports the breasts (e.g., cups). The "back" of the bra refers to that region of the bra that passes across a woman's back. The back of the bra often includes a clasp or other similar arrangement to facilitate putting on and taking off the bra. The "sides" of the bra are between the front and the back and in use are generally positioned under a woman's arm pits. As used herein, the "body" does not include the bra straps which typically support the bra in place over a woman's shoulder. Examples of bras suitable for the invention include, underwire bras, push-up bras, padded bras, pocket bras with removable padding, wireless bras, lace bras, etc.

In a typical embodiment of the invention, the bra straps can be attached to the garment support substantially along the length of the bra strap from the front to the back of the garment. According to the disclosure, the bra straps can be fastened to the garment shoulder supports using fasteners such as hook and loop (e.g., VELCRO®), snaps, zippers, buttons, loops, stitched thread, pattern (e.g., continuous, discontinuous, etc.), etc.

Fastening the bra straps to the garment supports, substantially along the length of the bra strap underlying the garment support, provides a neat appearance without constant visualization of the bra straps protruding outside the garment shoulder supports. By fastening the bra to the garment supports only in the over-the-shoulder regions, preferred embodiments of the herein disclosed articles of clothing also provide free movement of the garment relative to the body of the bra. Although not presently preferred, in some embodiments, the bra strap and garment support may be fastened only in the region from the front of the garment to the top of the shoulder or from the back of the garment to the top of the shoulder. According to this embodiment, in the former arrangement (i.e., fastened from front of garment to top of shoulder), the bra strap and garment support could extend to the back of the garment (or bra) not fastened to one another. In the latter arrangement, the bra strap and garment support could extend to the front of the garment (or bra) not fastened to one another.

In some embodiments, the garment supports may not extend to the back of the garment. For example, the garment supports may extend from the front of the garment and attach to one another behind the wearer's neck. In these embodiments, the garment supports and bra straps can be fastened together starting at about the front of the garment and extend together along the length of the garment support to a region of the garment support which in use would be positioned at, or behind, the wearer's neck. At this point, the support straps can be attached to one another by tying (e.g., a halter top) or using known clasping arrangements.

In a particularly advantageous embodiment, the disclosure provides for wearing a bra beneath a garment having narrow shoulder supports, such as "spaghetti straps." In a preferred embodiment, the garment is freely moveable relative to the body of the bra but fastened from the front to back of the garment along substantially the length of the garment shoulder support.

As used herein, the term "substantially" is used to indicate some variation in, for example, the location of a fastener, but the variation still providing the function within the scope and principles of the invention.

As will be disclosed below, the bra straps of the invention can be fastened to the garments to provide for removal of the bra from the garment. In some embodiments, the body of the bra can be detached from the straps, regardless of whether the straps are removable or non-removable from the garment supports. This feature advantageously provides for using the bra, or body of the bra, with different garments or the same garment with different bras or bra bodies. This aspect of the invention provides for articles of clothing to be available which have bra straps fastened to the garment supports, but no bra body. A selectively detachable bra body would be available separately. Alternatively, an article of clothing can be available with garment supports which include a fastener capable of fastening a removable bra, but no bra. Separate removable bras would also be available. These embodiments allow the consumer to mix and match garments and bras, or bra bodies.

DETAILED DESCRIPTION OF THE ILLUSTRATED EMBODIMENT

Figure 1B:
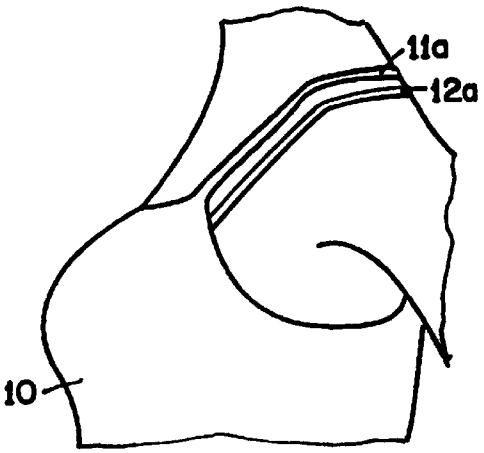
Figure 1A:
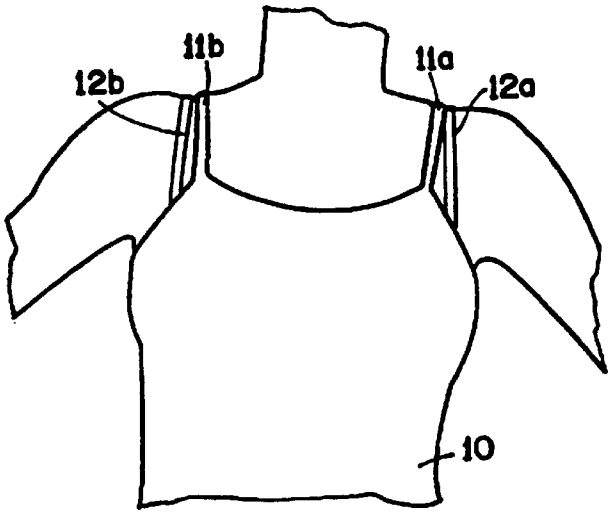

FIGS. 1*a*–1*c* illustrate one example of a problem with prior art arrangements of a bra and garment which is addressed by the present invention. In the illustrated embodiment, tank top 10 has garment supports 11*a* and 11*b* which are narrow and may be relatively displaced so as not to cover the bra straps 12*a* and 12*b* of the bra beneath the tank top 10. FIG. 1*b* is a side view and FIG. 1*c* is a back view of the same garment arrangement as FIG. 1*a*.

Figure 2C:
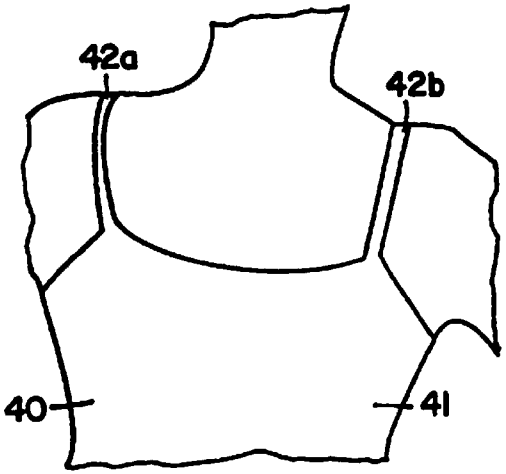
FIGS. 2*a*–2*c* illustrate one embodiment of a garment and bra arrangement according to the invention.
Figure 2B:
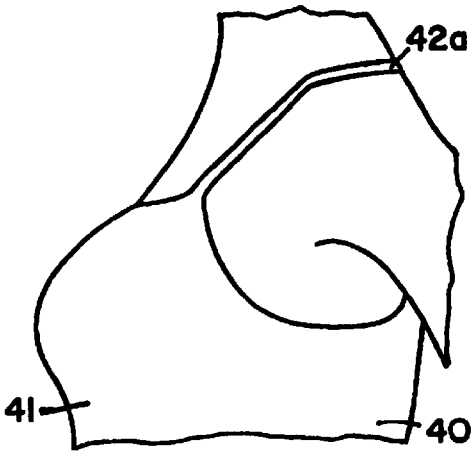
Figure 2A:
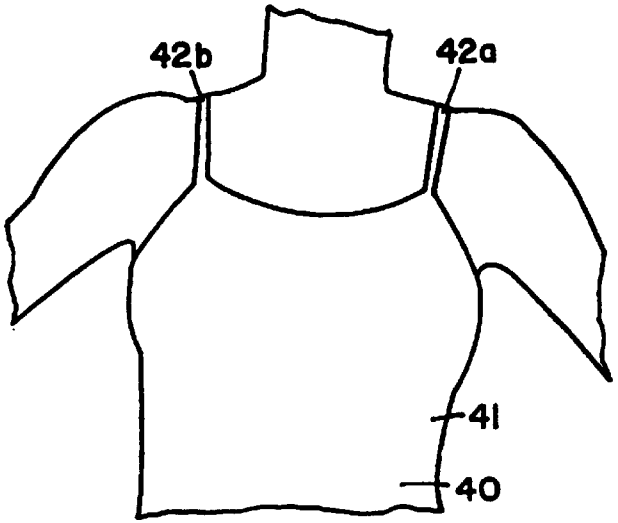
Figure 3A:
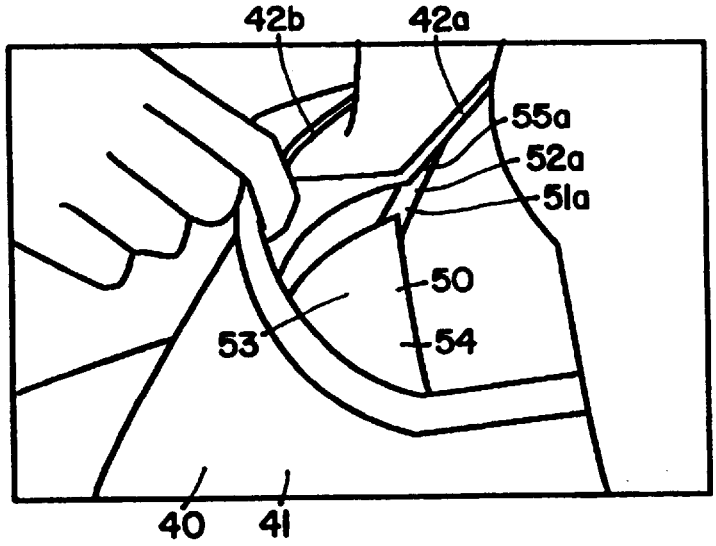
FIGS. 3*a* and 3*b* illustrate one preferred embodiment of the invention wherein the garment is freely moveable over the body of the bra while the garment supports are fastened along a portion of the bra straps.
Figure 3B:
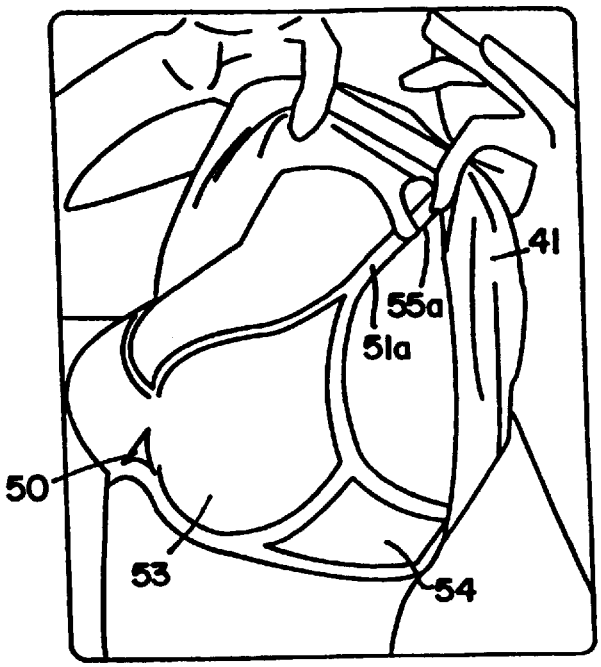

FIGS. 2*a*–2*c* illustrate one embodiment of a clothing article 40 according to the invention comprising a tank top 41 having garment supports 42*a* and 42*b* which are fastened to the bra straps (not visible) substantially along the length of the bra straps in the region of the garment supports. Referring to FIGS. 3*a* and 3*b*, in one preferred embodiment, garment shoulder supports 42*a* and 42*b* of clothing article 40 and bra straps 51*a* and 51*b* (not visible in this view), of bra 50 are fastened together substantially from the front end 55*a* of bra strap 51*a*, to the back of garment 41. FIG. 3*b* illustrates that in preferred embodiments, the region of the garment 41 which covers the body 54 of bra 50 can be freely removable from the body 53 of the bra.

Figures 4A, 4B:
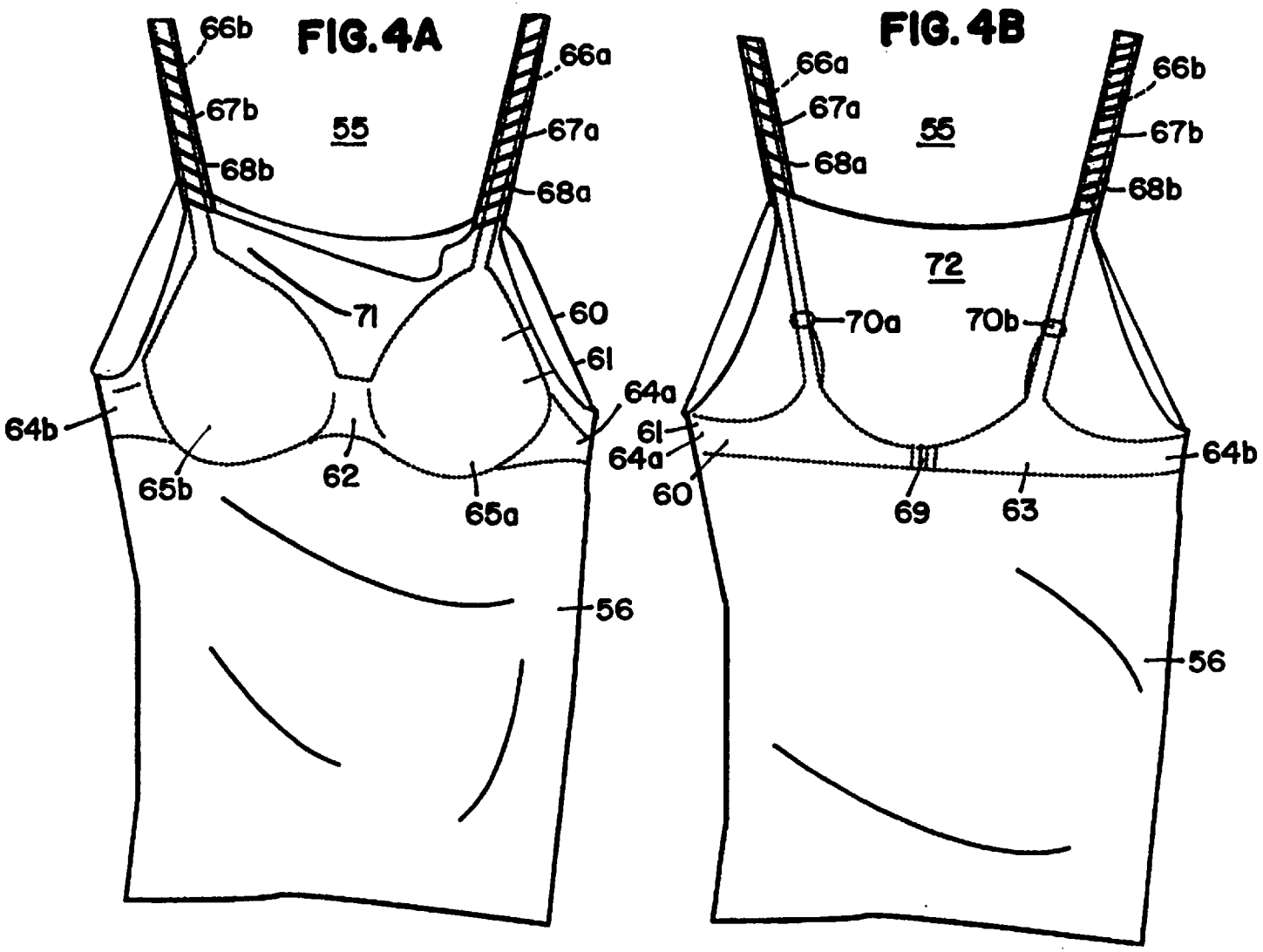
FIGS. 4*a* and 4*b* illustrate a front and back view of a garment with a bra beneath, in phantom lines, wherein the bra straps are fastened substantially along the garment supports.

FIGS. 4*a* and 4*b* illustrate a front and back view of another embodiment of a clothing article 55, such as a drape neck top 56, showing the body 60 of bra 61 in phantom lines. The body 60 of bra 61 includes a front 62, a back 63 and sides 64*a* and 64*b*. The front 62 of bra 61 includes cups 65*a* and 65*b*. The bra straps 66*a* and 66*b* (phantom lines) are fastened to the garment supports 67*a* and 67*b* of top 56 by fastener 68*a* and 68*b* which is represented in the illustration by diagonal lines. The fastener can provide for the bra to be non-removable from the garment such as by a threaded stitch, an adhesive, etc. or selectively removable by using, for example, hook and loop (VELCRO®). zipper, snaps, buttons, clasps, etc. If a threaded stitch is used, one or more rows of a continuous or intermittent stitch pattern can be used.

The back 63 of bra 61 includes a centrally located clasp 69 to facilitate putting on and taking off bra 61. In addition, an adjustment arrangement 70*a* and 70*b* can be provided for adjustment of the length of bra straps 66*a* and 66*b*, respectively. In the illustrated embodiment, the body 60 of bra 63 is not fastened to the top 56. However, bra straps 66*a* and 66*b* are fastened to garment supports 67*a* and 67*b* substantially along the length of the garment supports 67*a* and 67*b* from the front 71 to the back 72 of garment 56. Thus, the body 60 of bra 61 is freely moveable beneath top 56 for comfort and neat appearance. The unkempt appearance of the bra straps 66*a*, 66*b* displaced from beneath the garment supports 67*a*, 67*b* is eliminated.

Figure 5:
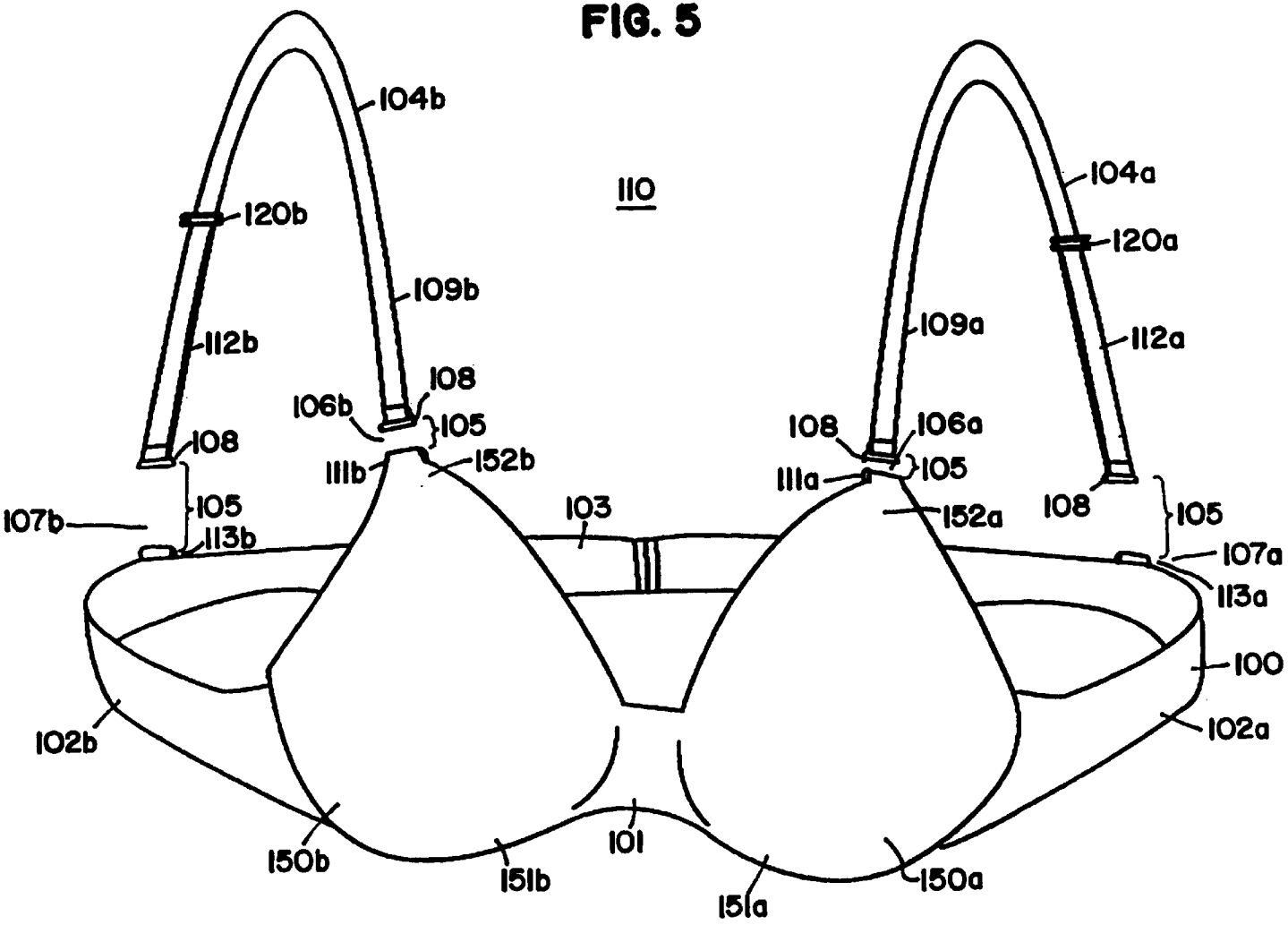
FIG. 5 illustrates an alternative embodiment of a bra according to the invention.
Figure 6:
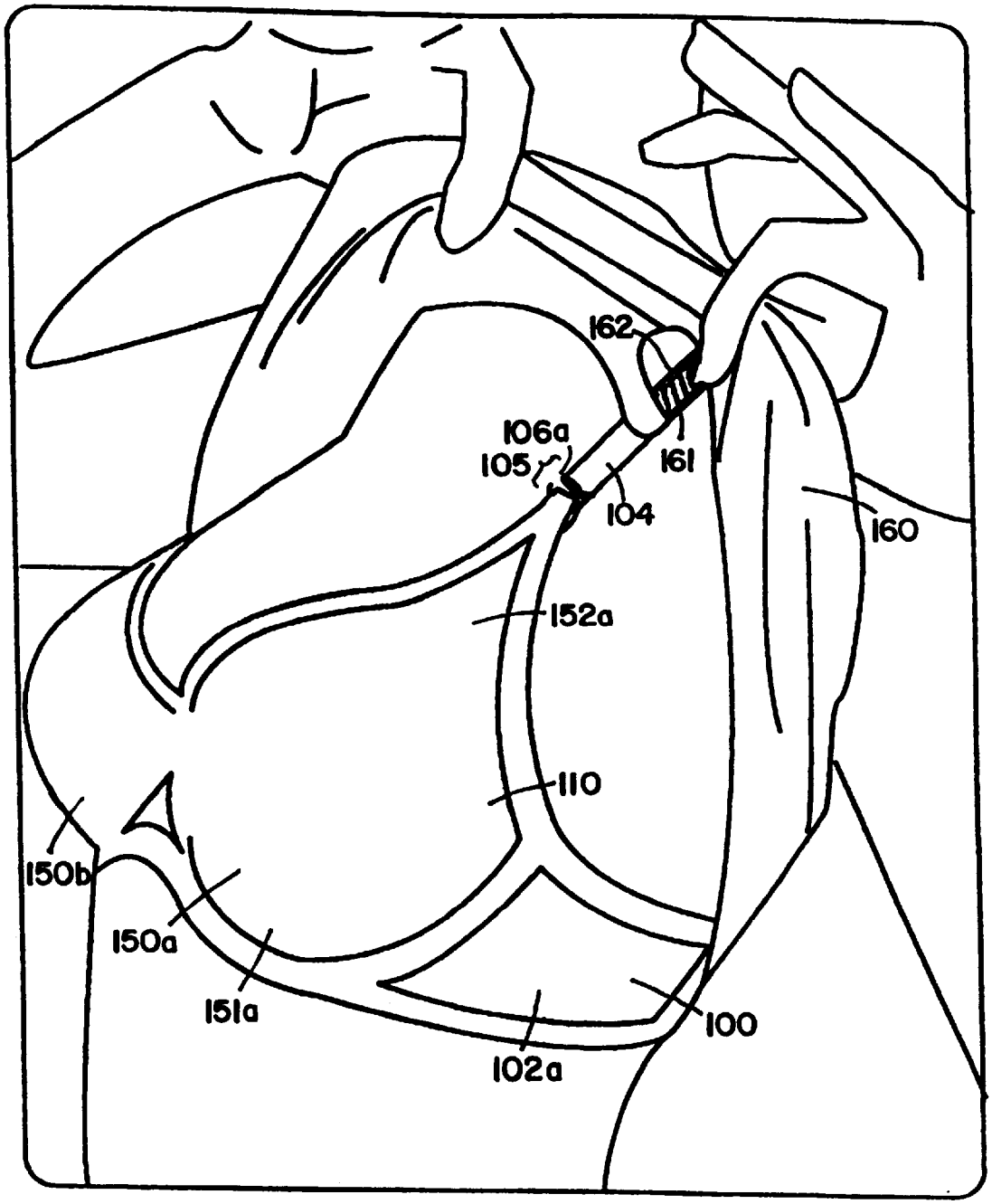
FIG. 6 illustrates an alternative embodiment of a garment and bra arrangement according to the invention including the bra of FIG. 5.

FIGS. 5 and 6, illustrate one embodiment of a bra of the invention wherein the body of the bra is selectively detachable from the bra straps. This embodiment permits interchangeability of bra bodies and garments. Referring to FIG. 5, bra 110 includes a body 100, comprising front 101, sides 102*a*, 102*b*, back 103, and straps 104*a*, 104*b*.

Front 101 of bra 110 comprises first cup 150*a* and second cup 150*b*. In this embodiment, cups 150*a* and 150*b* include a base region 151*a*, 151*b* and an apex region 152*a*, 152*b*. The tear-drop shape of cups 150*a* and 150*b* provides for positioning front attachments 106*a* and 106*b* at apex region 152*a*, 152*b* to provide even and comfortable support for the wearer. This bra cup configuration also provides a smoother appearance under a garment without a visible defining line at the top edge of the bra. In this embodiment, body 100 is attached to the bra straps 104*a*, 104*b* by strap attachment arrangement 105 which provides for selectively attaching and detaching the bra straps 104*a*. 104*b* to the front 101 and back 103 of the body 100 of bra 110. According to this embodiment, strap attachment arrangement 105 can include front attachments 106*a*, 106*b* which are the same or different than back attachments 107*a*, 107*b*. In the illustrated embodiment, front attachments 106*a*, 106*b* each include a hook members 108, mounted at the front ends 109*a*, 109*b* of straps 104*a*, 104*b*, to selectively attach and detach from loop members 11*a*, 11*b* at the front 101 of bra 110. Back attachments 107*a*. 107*b* each also include hook members 108 mounted at the back ends 112*a*, 112*b* of straps 104*a*. 104*b* which can selectively attach and detach from loop members 113*a*, 113*b* at the back 103 of bra 110. It will be appreciated that the relative locations of the hook members and loop members can be the inverse of that illustrated. Also, other strap attachment arrangements 105, which provide for selective detachability of the body of the bra from the straps, such as hook and loop (VELCRO®), buttons, snaps, clasps, zippers, etc., can be used.

As illustrated, an adjustment arrangement 120*a* and 120*b* can be included for adjusting the length of bra straps 104*a*, 104*b*. Suitable adjustment arrangements are known in the art.

FIG. 6 illustrates that the feature of selective detachability of body 100 of bra 110 from straps 104*a* and 104*b* (not visible) still permits for the bra 110 to be freely moveable beneath a garment 160. In addition, as described previously for other embodiments, a clothing article including a strap attachment arrangement 105 for selective detachment of the bra body 100 can include a fastener 161 which provides for the bra straps to be removably or non-removably fastened to the garment supports.

Figure 7:
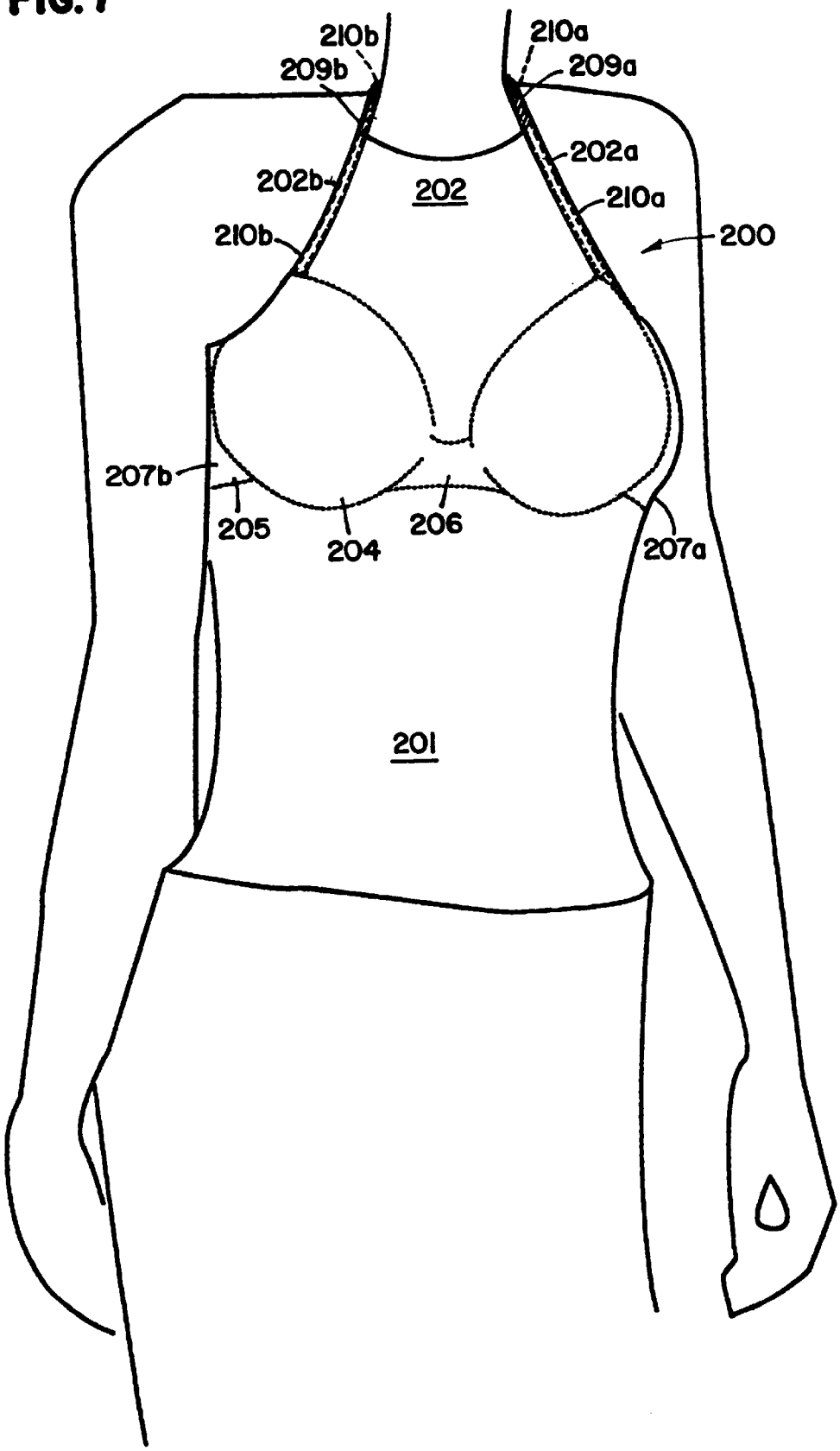
FIG. 7 illustrates a front view of an alternative embodiment of an article of clothing according to the invention.
Figure 8:
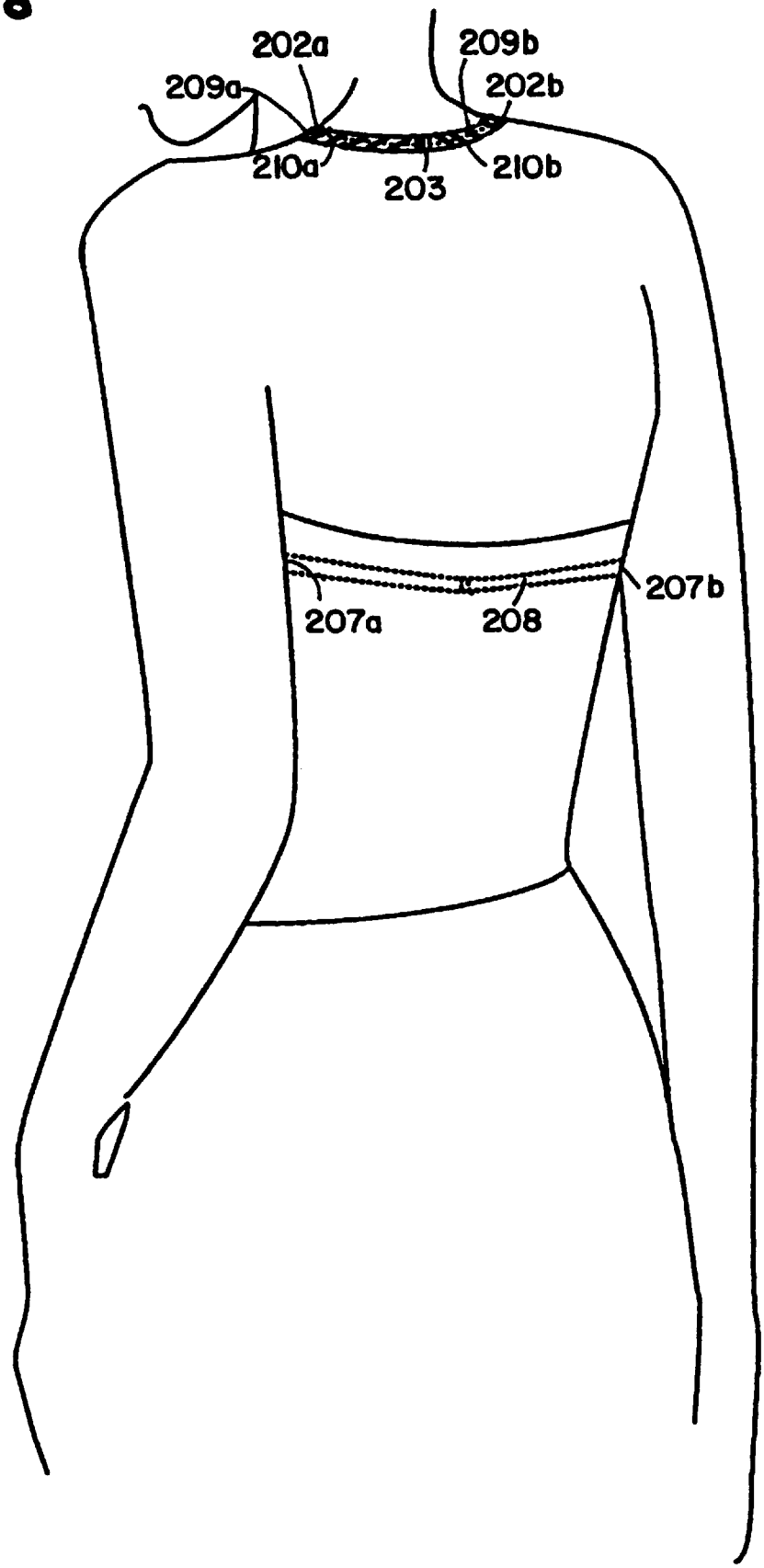
FIG. 8 illustrates a back view of the embodiment of FIG. 7.

FIGS. 7 and 8 illustrate an alternative embodiment of an article of clothing 200 according to the invention. According to this embodiment, garment 201 includes garment supports 202*a*, 202*b* which attach to each other using a garment support attachment 203 behind the wearer's neck. As illustrated in phantom lines, bra 204 includes a body 205 having a front 206, sides 207*a*, 207*b* and back 208. Article of clothing 200 includes fastener 209*a* and 209*b* (diagonal lines) to fasten bra straps 210*a* and 210*b* (hatched line) to garment supports 202*a*, 202*b* from the front 220 of the garment 201 to near the garment support attachment 203 using previously described removable or non-removable fasteners. Also, as described for other embodiments, bra 204 can include a body 205 which is selectively detachable or non-selectively detachable to bra straps 210*a* and 210*b*.

Figures 9, 10:
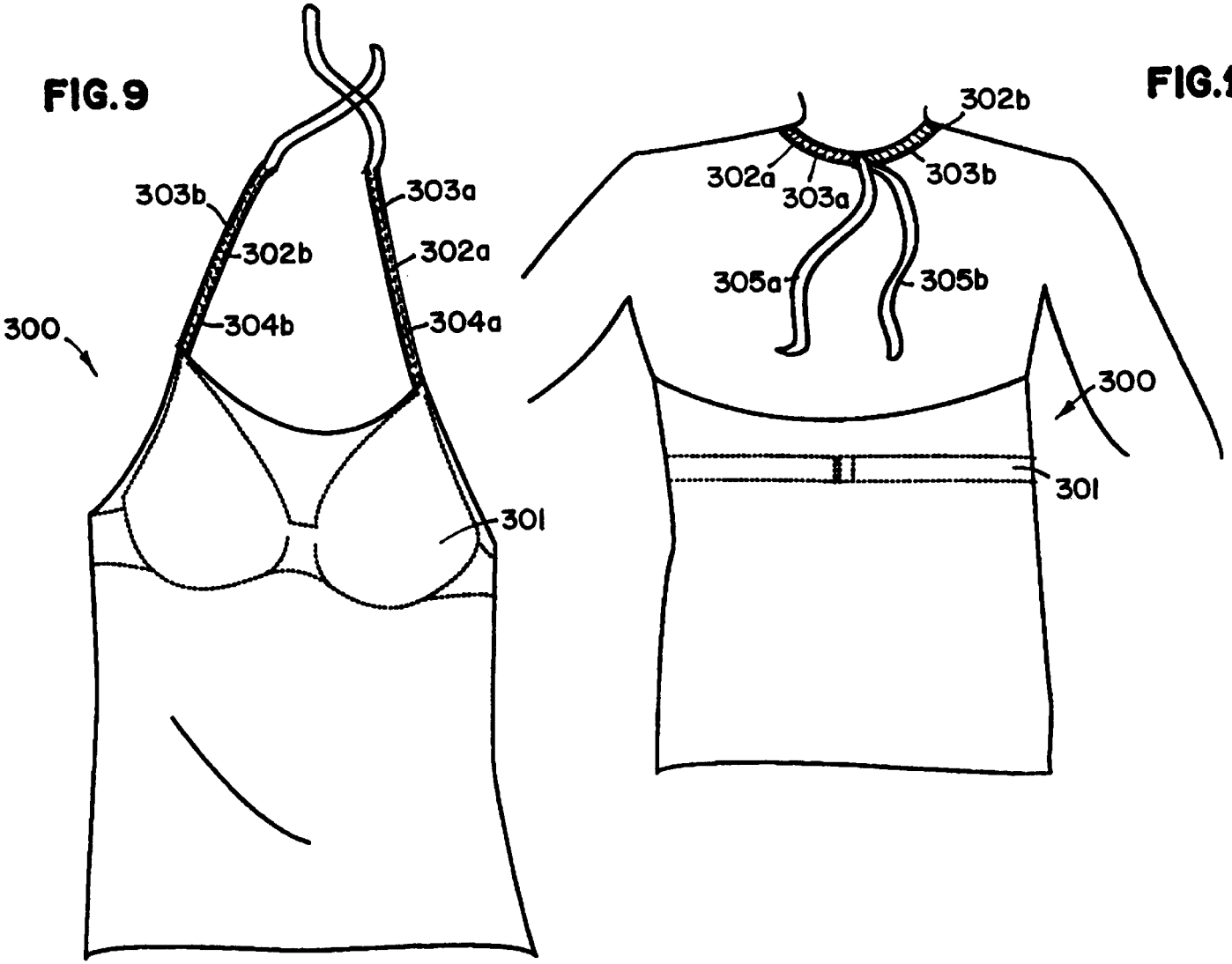
FIG. 9 illustrates a front view of an alternative embodiment of an article of clothing according to the invention.
FIG. 10 illustrates a back view of the embodiment of FIG. 9.

Referring to FIGS. 9 and 10, in another embodiment, a halter top 300, including a removable or non-removable, detachable or non-detachable bra 301, is illustrated. According to this embodiment, the bra straps 302*a*, 302*b* of bra 301 are fastened by a fastener 303*a*, 303*b* (diagonal lines) along a portion of garment supports 304*a*, 304*b*, preferably extending at least a distance along the support straps 303*a*, 303*b* to near the wearer's neck. The bra straps 302*a*, 302*b* can extend to the end of ties 305*a*, 305*b* (i.e., garment supports) or stop at or near the wearer's neck as illustrated.

Figure 12:
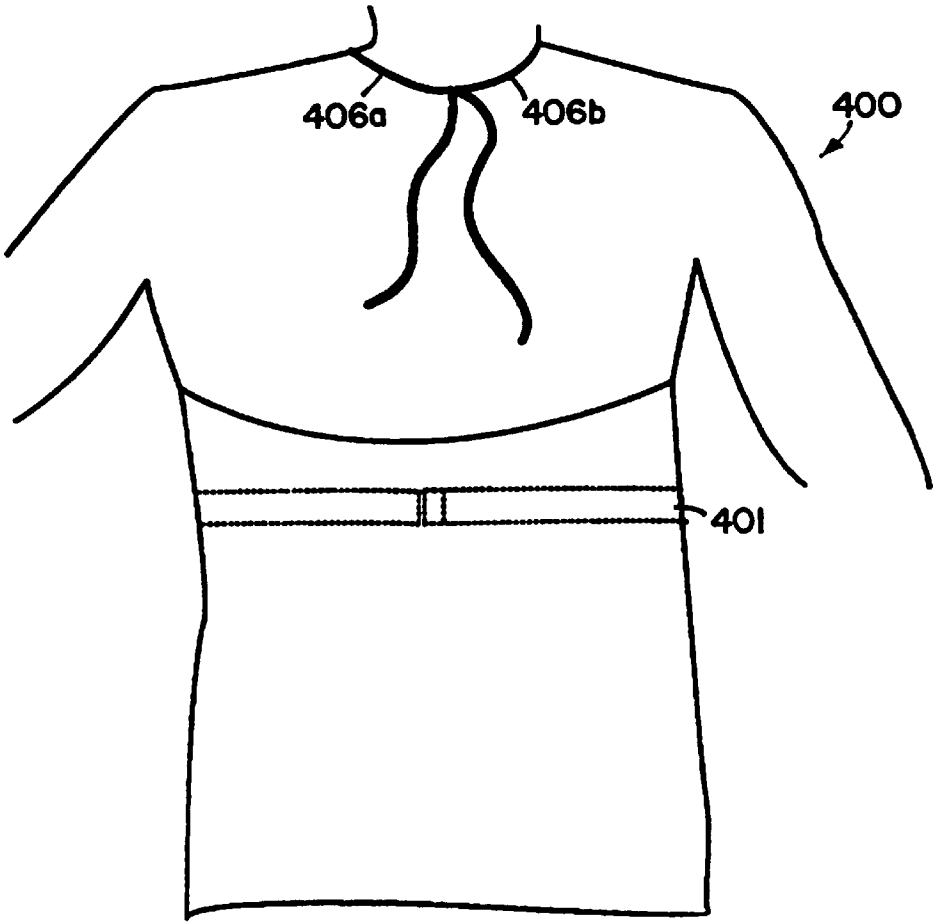
FIG. 12 illustrates a back view of the embodiment of FIG. 11.
Figure 11:
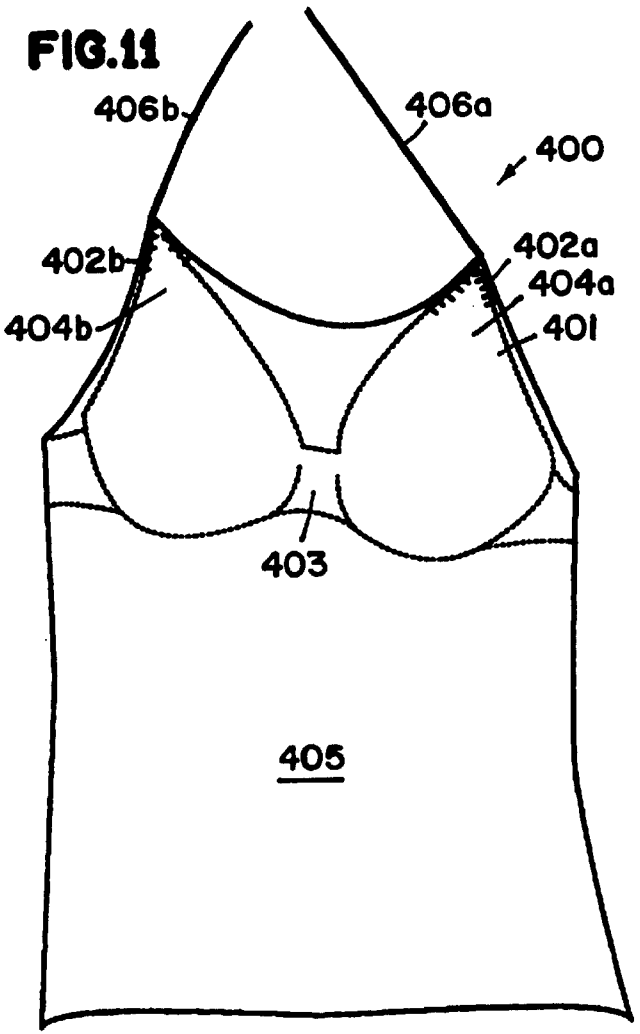
FIG. 11 illustrates a front view of an alternative embodiment of an article of clothing according to the invention.

In another embodiment of a halter top 400, shown in FIGS. 11 and 12, a bra 401 lacking bra straps may be used. According to this embodiment, small triangular shaped regions 402*a*, 402*b* at the front 403 of bra 401, near each of the apexes 404*a*, 404*b*, are attached to the garment 405. The small regions 402*a*, 402*b* of attachment can also be used in clothing articles wherein bra straps are present and fastened to the garment support.

Figure 13B:
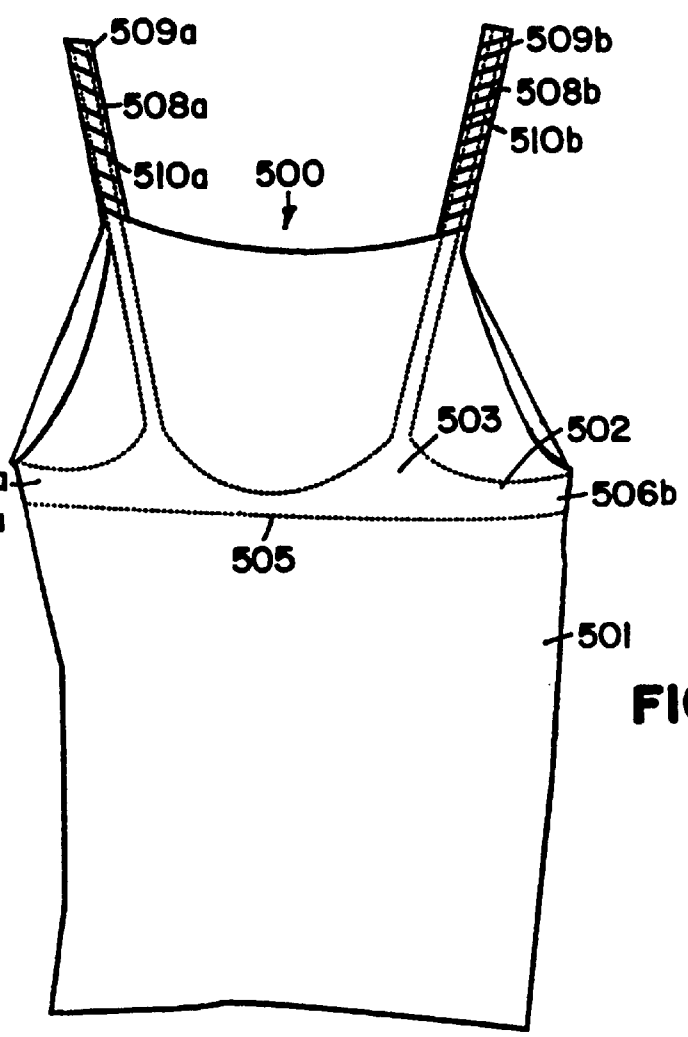
FIGS. 13*a* and 13*b* illustrate an alternative embodiment of an article of clothing according to the invention.
Figure 13A:
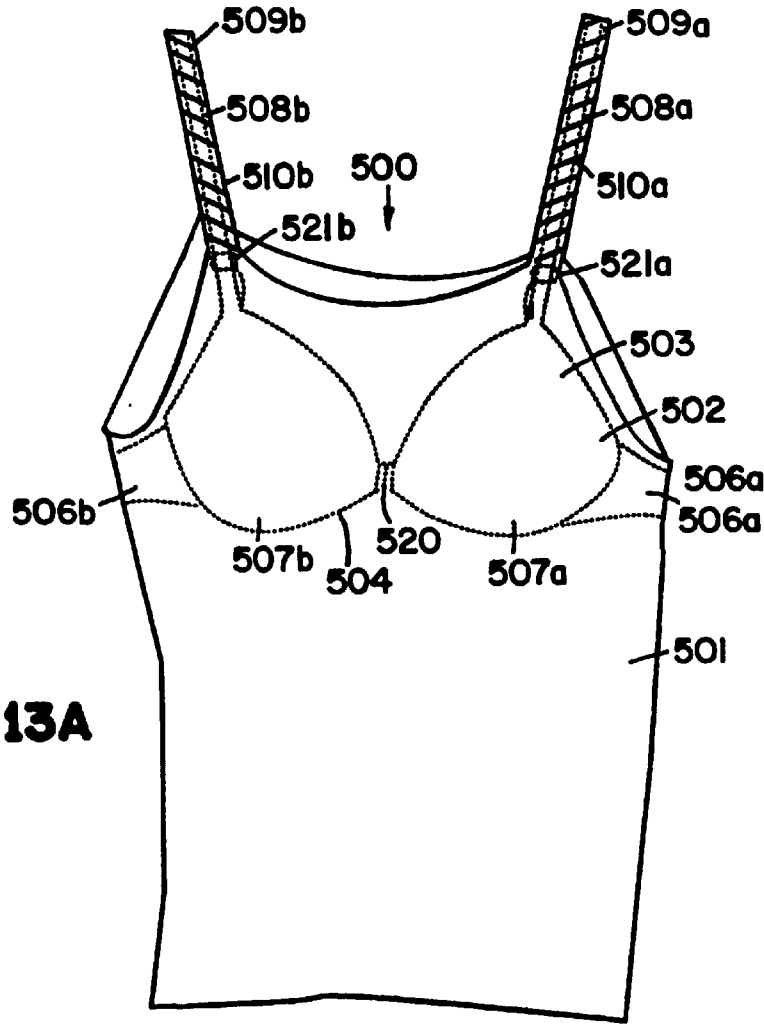

FIGS. 13*a* and 13*b* illustrate a front and back view of another embodiment of a clothing article 500, such as tank top 501, showing the body 502 of bra 503 in phantom lines. The body 502 of bra 503 includes a front 504, a back 505 and sides 506*a* and 506*b*. The front 504 of bra 503 includes cups 507*a* and 507*b*. The bra straps 508*a* and 508*b* (phantom lines) are fastened to the garment supports 509*a* and 509*b* of tank top 501 by fastener 510*a* and 510*b* which is represented in the illustration by diagonal lines. The fastener can provide for the bra to be non-removable or removable from the garment as discussed for other embodiments of the invention. FIGS. 13*a* and 13*b* also illustrate that a bra strap adjustment arrangement 521*a*, 521*b* can be located along bra straps 508*a* and 508*b*, respectively, near the front 504 of the body 502 of bra 503. Also, as illustrated in this embodiment, rather than having a central clasp at the back 505 of the body 502 of bra 503 for facilitating putting the bra on and taking bra off, a clasp 520 can be located at the front 504 of the body 502 of bra 503.

Figure 14B:
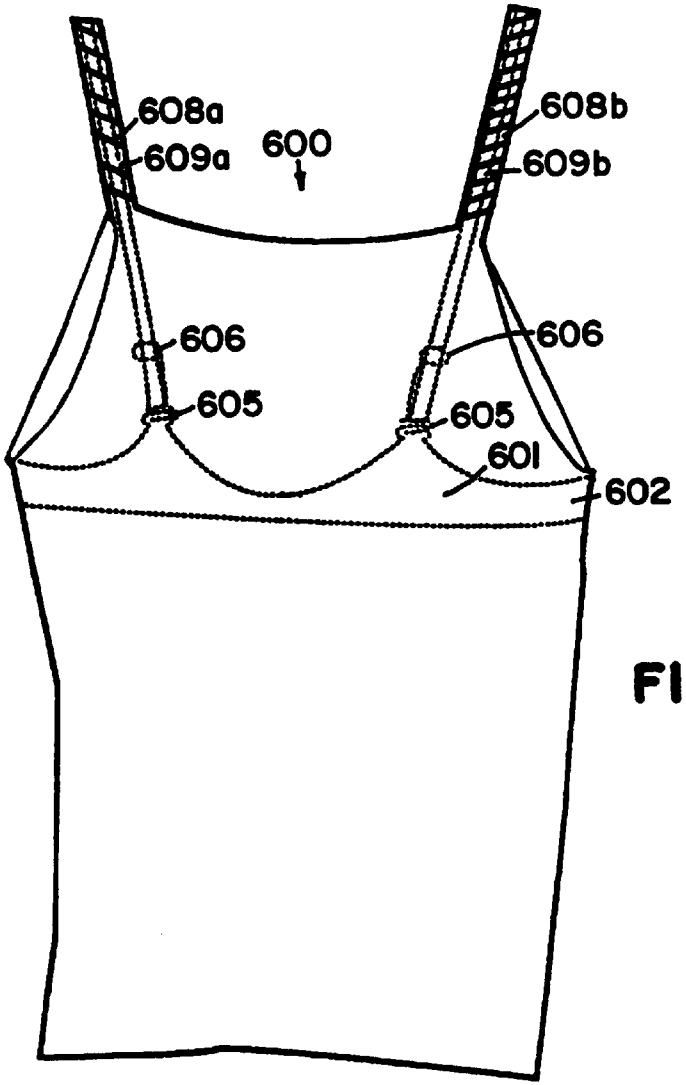
FIGS. 14*a* and 14*b* illustrate another alternative embodiment of an article of clothing according to the invention.
Figure 14A:
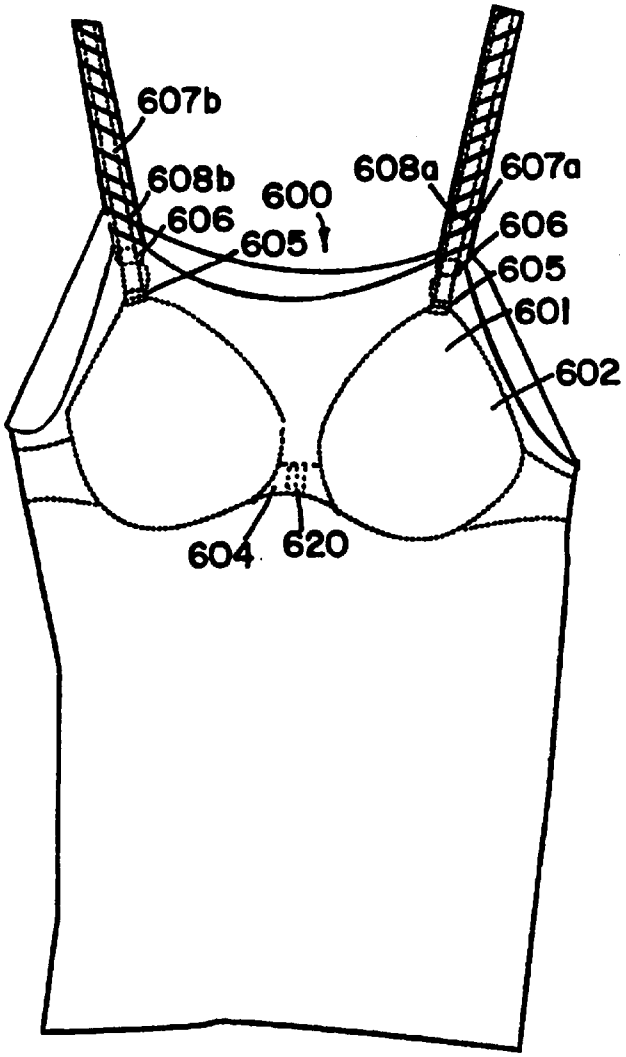

FIGS. 14*a* and 14*b* illustrate an article of clothing 600 wherein the body 601 of bra 602 includes a clasp 620 at the front 604 of the body 601. A strap attachment arrangement 605 for selectively detaching the body 601 of bra 602 is illustrated. In addition, this embodiment shows that an article of clothing 600 can have strap adjustment arrangements 606 located at the front 607*a*, 607*b* of bra straps 608*a*, 608*b* and/or at the back 609*a*, 609*b* of bra straps 608*a*, 608*b*.

In addition, a bra of the invention can also include a bra body having a clasp arrangement at the front and back of the body of the bra to facilitate putting on and taking off the bra. Such a bra body can be removable or non-removable from the garment and the bra body can be non-detachable or selectively detachable from the bra straps. Also, although not presently preferred, an article of clothing can also have a hook member mounted at the front ends and back ends of the garment supports. A previously described bra body can include loop members at the front and back of the bra body to selectively detach the bra body from the hook members at the garment supports. As discussed previously, the relative locations of the hook members and loop members (or other strap attachment arrangements) can be inverse to that stated. However, because this embodiment lacks bra straps, it is less preferred for providing support than other embodiments of the invention.

The disclosed arrangements provide for the bra straps to fully support the body of the bra without relative displacement of the bra straps from beneath the garment supports. Thus, an article of clothing according to the invention eliminates the need for repeated rearrangement of the garment support and the bra strap to keep the bra strap hidden beneath the garment support. Also, unlike safety pins, clasps or other devices that provide a point fixation between the garment support and the bra strap, the fasteners of the present invention not only maintain the relative position of the garment support to the bra strap but also eliminate visualization of the bra strap in regions away from single point fixation when bending, turning or performing some other movement that can cause the bra strap to separate from the garment support if only fixed together at a single point.

Fixation of the bra strap to the garment shoulder support is advantageous for use with sleeveless garments, and particularly garments with a narrow (thin) shoulder supports (e.g., spaghetti straps) for providing a neater appearance. Fastening the bra strap to the garment support according to the invention is particularly beneficial to women needing a B-cup bra or larger as well as women needing an A-cup who may wish to include padding within the bra. It will be appreciated that an article of clothing according to the invention can include bras having varied cup sizes, thicknesses, with or without underwires, pads, push-ups or any other components which may be used with or as a part of the bra.

The articles of clothing according to the invention advantageously provide breast support with increased comfort for regular use or for jogging, running, skiing or other physical activity with a feeling of security and without the pain which can be associated with un-supported breasts.

The entire disclosure of all patents cited in this disclosure are incorporated herein by reference.

From the foregoing detailed description it has been shown how the objects of the invention have been obtained in a preferred manner. However, modifications and equivalence of the disclosed concepts such as those which would occur to one of ordinary skill in the art are intended to be included within the scope of the present invention.

What I claim is:

1. An article of clothing comprising:

(a) a first garment support having a first front end and a first back end, and a first strap attachment arrangement adjacent the first front end of the first garment support, the first strap attachment arrangement configured and arranged to cooperatively attach to a bra body having a front, a back, and two sides; and (b) a second garment support having a second front end and a second back end, and a second strap attachment arrangement adjacent the second front end of the second garment support, the second strap attachment arrangement configured and arranged to cooperatively attach to the bra body.

2. The article of clothing according to claim 1 further comprising the bra body.

3. The article of clothing according to claim 1 wherein the first and second garment supports are spaghetti straps.

4. The article of clothing according to claim 1 wherein the garment is a dress.

5. The article of clothing according to claim 4, therein the first and second garment supports of the dress are spaghetti straps.

6. The article of clothing according to claim 1 wherein the garment is a tank top.

7. The article of clothing according to claim 6 wherein the first and second garment supports of the tank top are spaghetti straps.

8. The article of clothing according to claim 1 wherein the garment is a halter top.

9. The article of clothing according to claim 8 wherein the first and second garment supports are configured to be connected at the first back end and the second back end.

10. The article of clothing according to claim 1 wherein the garment is a blouse.

11. The article of clothing according to claim 2 wherein the first and second strap attachment arrangements are hooks and the bra body includes loops configured to cooperatively attach to the hooks.

12. The article of clothing according to claim 2 wherein the first and second strap attachment arrangements are snaps and the bra body is configured to cooperatively attach to the snaps.

13. An article of clothing comprising:

(a) a first garment support having a first front end and a first back end;

(b) a first strap adjacent and extending along at least a portion of the first garment support, the first strap having a first strap attachment arrangement adjacent the first front end of the first garment support, the first strap attachment arrangement configured and arranged to cooperatively attach to a bra body having a front, a back, and two sides;

(c) a second garment support having a second front end and a second back end; and (d) a second strap adjacent and extending along at least a portion of the second garment support, the second strap having a second strap attachment arrangement adjacent the second front end of the second garment support, the second strap attachment arrangement configured and arranged to cooperatively attach to the bra body.

14. The article of clothing according to claim 13 further comprising the bra body.

15. The article of clothing according to claim 13 wherein the first and second garment supports are spaghetti straps.

16. The article of clothing according to claim 13 wherein the garment is a dress.

17. The article of clothing according to claim 13 wherein the garment is a tank top.

18. The article of clothing according to claim 13 wherein the garment is a halter top.

19. The article of clothing according to claim 14 wherein the first and second strap attachment arrangements are hooks and the bra body includes loops configured to cooperatively attach to the hooks.

20. The article of clothing according to claim 13 wherein the first and second straps are removable from the first and second garment supports, respectively.

* * * * *